US007932794B2

(12) United States Patent
Suter

(10) Patent No.: US 7,932,794 B2
(45) Date of Patent: Apr. 26, 2011

(54) ELECTRO-MECHANICAL ACTUATOR, AND A HIGH OR MEDIUM VOLTAGE DISCONNECTOR HAVING SUCH AN ACTUATOR

(75) Inventor: Ernst Suter, Kolliken (CH)

(73) Assignee: Areva T&D AG, Oberentfelden (CH)

( * ) Notice: Subject to any disclaimer, the term of this patent is extended or adjusted under 35 U.S.C. 154(b) by 359 days.

(21) Appl. No.: 12/260,949

(22) Filed: Oct. 29, 2008

(65) Prior Publication Data

US 2009/0108689 A1 Apr. 30, 2009

(30) Foreign Application Priority Data

Oct. 29, 2007 (FR) ..... 07 58657

(51) Int. Cl.
*H01H 3/00* (2006.01)
*H01H 9/00* (2006.01)
*H01H 51/00* (2006.01)

(52) U.S. Cl. ..... 335/68; 335/71

(58) Field of Classification Search ..... 335/68, 335/71, 74; 200/48 R
See application file for complete search history.

(56) References Cited

U.S. PATENT DOCUMENTS 3,332,043 A * 7/1967 Camp ..... 335/71
5,311,161 A * 5/1994 Calder et al. ..... 335/68
5,693,923 A * 12/1997 Gula et al. ..... 200/50.26
5,808,532 A * 9/1998 DiVincenzo et al. ..... 335/68
5,861,784 A * 1/1999 Heise et al. ..... 335/20
6,577,214 B1 * 6/2003 DeGrazia et al. ..... 335/68
6,693,502 B2 * 2/2004 Yang ..... 335/68
7,019,606 B2 * 3/2006 Williams et al. ..... 335/20
2003/0090349 A1 * 5/2003 Mody et al. ..... 335/68

FOREIGN PATENT DOCUMENTS

CH 424 932 A 11/1966
DE 1690093 B1 10/1971
EP 0455039 A 11/1991

OTHER PUBLICATIONS

French Preliminary Search Report, FR 07 58657, dated Jun. 13, 2008.

* cited by examiner

*Primary Examiner* — Elvin G Enad
*Assistant Examiner* — Alexander Talpalatskiy
(74) *Attorney, Agent, or Firm* — Nixon Peabody LLP

(57) ABSTRACT

An electro-mechanical actuator having means for transmitting motion, in the final part of a stroke performed by a system comprising a worm shaft and rider nut coupled through gearing with an electric motor, to an auxiliary interrupter for breaking the power supply to the motor. Two control levers are provided, these being coupled together, and being rotated, about a perpendicular axis, by a cursor which is fixed to the nut that slides on the worm shaft. The pivoting of the said levers is blocked during the movement of the drive shaft driven by the system consisting of the worm shaft and nut. By contrast, the levers pivot during the final part of the movement of the cursor. The distance through which the levers move in pivoting is large enough to avoid any need for the auxiliary interrupter to be a high precision component.

11 Claims, 6 Drawing Sheets

ELECTRO-MECHANICAL ACTUATOR, AND A HIGH OR MEDIUM VOLTAGE DISCONNECTOR HAVING SUCH AN ACTUATOR

CROSS REFERENCE TO RELATED APPLICATIONS OR PRIORITY CLAIM

This application claims priority to French Patent Application No. 07 58657, filed Oct. 29, 2007.

TECHNICAL FIELD AND PRIOR ART

This invention relates to the field of actuators, of the type having an electric motor and a gear drive for transmission of motion from the motor to a drive shaft between two predetermined positions.

It is applicable to actuators for interrupters such as disconnectors, and more particularly to medium or high voltage disconnectors.

In medium or high voltage disconnectors, it is known to use, by way of an actuator, an electric motor, a gear drive for transmitting the motion from the motor to a drive shaft between two predetermined positions corresponding to the open and closed positions of the movable main contact of the interrupter, and finally at least one first auxiliary interrupter for breaking the power supply to the motor once the main contact has reached its closed or open position.

It is also known to synchronize the deflection of the movable contact of the first auxiliary interrupter with the closed position of the movable main contact of the disconnector.

Finally, it is known to synchronize deflection of the movable contact of the first auxiliary interrupter with the deflection of a movable contact of a second auxiliary interrupter that serves to signal the state of switching (I/O) of the disconnector.

Accordingly the document CH 424 932 teaches an actuator for an interrupter that comprises an electric motor, a toothed wheel 11 coupled with the output shaft of the motor and fixed relative to a worm or leadscrew drive system 5, 6 having a cursor nut 6, which, through a forked lever 7, causes rotation of a main shaft that is coupled to a contact of the interrupter, which may for example be a disconnector. The forked lever 7 is so designed as to enable the rider or cursor nut 6 to move freely after the end of the movement of the main shaft. At the end of this free stroke, the power supply to the motor is cut off, and the motor and the cursor nut 6 of the leadscrew system stop. A stack of Belleville rings 20, constituting a spring, damps out the braking action of the cursor nut 6. The leadscrew 5 has a relief which releases the nut 6 at the end of the maneuver. The Belleville rings 20 cause the nut 6 to be re-engaged on the leadscrew 5 during rotation in the opposite sense. The engagement of the nut thereby made gives rise to substantial forces in the worm shaft (or leadscrew) 5 of the leadscrew system, and in the chassis 4. In addition, the relief zone of the nut 6 and the leadscrew are subject to a high degree of wear. This then makes it necessary to re-dimension the mechanism in relation to its primary function, namely that of causing the main shaft to rotate. The said document is not concerned with how the auxiliary interrupter contacts are controlled over a long stroke of movement.

The document DE 1 690 093 teaches an improvement on the actuator described in Patent CH 424 932, which improvement consists in the provision of an additional interrupter for operating an electric brake of the motor during the free travel (i.e. the last part of the movement of the cursor 6). The use of such an electric brake for the motor is not an expedient that is optimal in terms of cost. It is necessary to provide a remedy for the stresses set up by high short circuit currents. As to this, a high short circuit current considerably increases the load on the electrical parts (such as windings, interrupters and so on) and on the mechanical parts (such as fastenings, gears and so on).

The document DE 1 690 093 resolves this problem with a resistor that is connected electrically to the brake, converting to heat the electrical energy resulting from braking action. That solution is costly, due to the use of a resistor, the need to manage the recuperated heat, and so on.

The document EP 0 455 039 teaches an actuator for an interrupter that includes a rotatable shaft 1 that displaces a cursor nut 2 with a finger 5 lodged in a slot 6, the shape of which is adapted to cause rotation of a main shaft 4, which is fixed to a contact of the interrupter. An indicating device 12 is provided, which has a slot 13 and which is controlled by the finger 5 in displacement so that it pivots. The indicating device 12 may have a toothed section 15 for rotating a pinion 16 and its shaft 17, to which it is fixed. The rotation of the shaft 17 actuates the auxiliary interrupter so as to cut off the power supply to the motor (not shown) that rotates the shaft 1. The pivoting motion of the indicating device 12 is not long enough. The use of a pinion such as the pinion 17, and use of the balancer 3, is not the best solution in terms of cost. Moreover, the said document does not propose any way of effecting braking at the end of the movement.

The object of the invention is to propose a new type of electro-mechanical actuator, in particular for high or medium voltage disconnectors, that is less expensive, and more reliable, than those that exist at present.

DISCLOSURE OF THE INVENTION

To this end, the invention provides an actuator of an electromagnetic type comprising:

an electric motor;

a gear drive, including a worm shaft adapted to be rotated by the motor, and a rider nut that is in threaded engagement with, and around, the worm shaft and that has a guide finger and a cursor spindle;

a lever having a fork and fixed to a drive shaft that extends at a right angle to the worm shaft, the lever being so positioned as to locate the guide finger in the fork between two predetermined positions on the worm shaft, whereby to rotate the drive shaft between two predetermined positions;

a first auxiliary interrupter for breaking the power supply to the electric motor at the end of the stroke of the cursor; and transmission means for transmitting the movement of the cursor at the end of the stroke of the first auxiliary interrupter, whereby to put it in a switching position, the said transmission means comprising a pair of coupled-together control levers, one said control lever being coupled to a movable contact of the first auxiliary interrupter, each of the control levers being pivoted about a pivot pin which is orthogonal to the worm shaft, and each said control lever having a guide edge, the arrangement of the levers and the profiles of their guide edges being such as to enable the cursor to slide on the guide edges regardless of the position on the worm shaft, by causing the control levers to stop or pivot simultaneously, whereby the simultaneous pivoting movement of the levers puts the auxiliary interrupter into a switching position.

In this way, an electromechanical actuator is obtained that is less expensive, firstly due to the reduction in the number and weight of the components used in the construction of the actuator, and secondly, because components, which up to the present time have been castings, are replaced by parts fabricated from bended metal sheet.

Preferably, each lever guide edge has a straight first portion and a curved portion continuous with its straight portion, the respective lengths of the straight first portion and the curved portion being such as to permit the cursor to slide in the said portions as follows:

in the straight portions, aligned with each other, without causing the control levers to pivot when the drive shaft is between the two said predetermined positions; and in the curved portions by causing the control levers to pivot simultaneously when the drive shaft is in a position immediately after one of the said predetermined positions.

Advantageously, each guide edge includes a second straight portion continuous with the curved portion, the length of the second straight portion being such as to permit the cursor sliding in it to stop without any pivoting movement of the levers, after the power supply to the electric motor has been broken by the auxiliary interrupter in its switching position.

In another version, the two parts are coupled together by means of a first coupling bar. The control levers may be coupled together in such a way as to pivot in the same direction of rotation.

According to a further advantageous feature, one of the control levers is coupled to the first auxiliary contact by means of a second coupling bar.

In a preferred embodiment, two cylinders extend parallel to the drive shaft and are positioned at a distance such that each of them acts as an end stop for the lever having the fork in one of the two predetermined positions of the drive shaft.

The two control levers are preferably identical to each other.

In an advantageous version of the invention, one of the control levers is coupled to a slider member, the coupling between the said lever and the slider being so arranged that, when the lever is in its pivoted position corresponding to a position of the cursor beyond the two said predetermined positions, the slider, in straight line movement, actuates a mechanical brake for the gear drive, and, when the lever is in an unpivoted position corresponding to an intermediate position of the cursor between the two said predetermined positions, the slider, in straight line movement in the opposite direction, releases the mechanical brake.

The two pivoting levers, arranged in this way within the scope of the invention, are rotated around a perpendicular axis by the cursor of the nut sliding on the worm shaft. The pivoting action of the levers is blocked during the movement of the high voltage main contact or contacts of the interrupter, for example a disconnector, which has the actuator of the invention. In contrast the levers do rotate during the final part of the movement of the cursor. The amount by which the components pivot is large enough to permit the use, for breaking the power supply to the motor, of an auxiliary interrupter which has a conventional degree of precision: in other words it is not necessary to resort to a high precision auxiliary interrupter.

As compared with the high voltage disconnector actuators of the prior art, the actuator of this invention defines a control device which includes two auxiliary levers, preferably identical to each other, guides for rotational movement about two axes at night angles to the worm shaft, which are so disposed that, over the two final parts of the cursor movement, the transmission ratio between the linear displacement of the cursor and the rotational displacement of the levers is high. This enables a high degree of precision to be obtained in the auxiliary interrupter, and enables fabricated sheet metal to be used in place of molded parts for the base, such as a pedestal, and for the main support member and the casing of the actuator, all of this despite the reduction in production costs.

The actuator discussed above may include a body frame of the above-mentioned actuator, with at least one main support on which the drive shaft is rotatably mounted, and a base on which the motor and gear drive are fitted, the main support and the base being preferably fabricated from bended metal sheet.

Finally, the invention provides an interrupter such as a grounding disconnector, having an actuator of an electromechanical type as described above, wherein the drive shaft is the drive shaft for the main movable contact or contacts of the interrupter, the said predetermined positions of the drive shaft being the open position and the closed position of the main contact or contacts.

DETAILED DESCRIPTION OF PARTICULAR EMBODIMENTS

Figure 1:
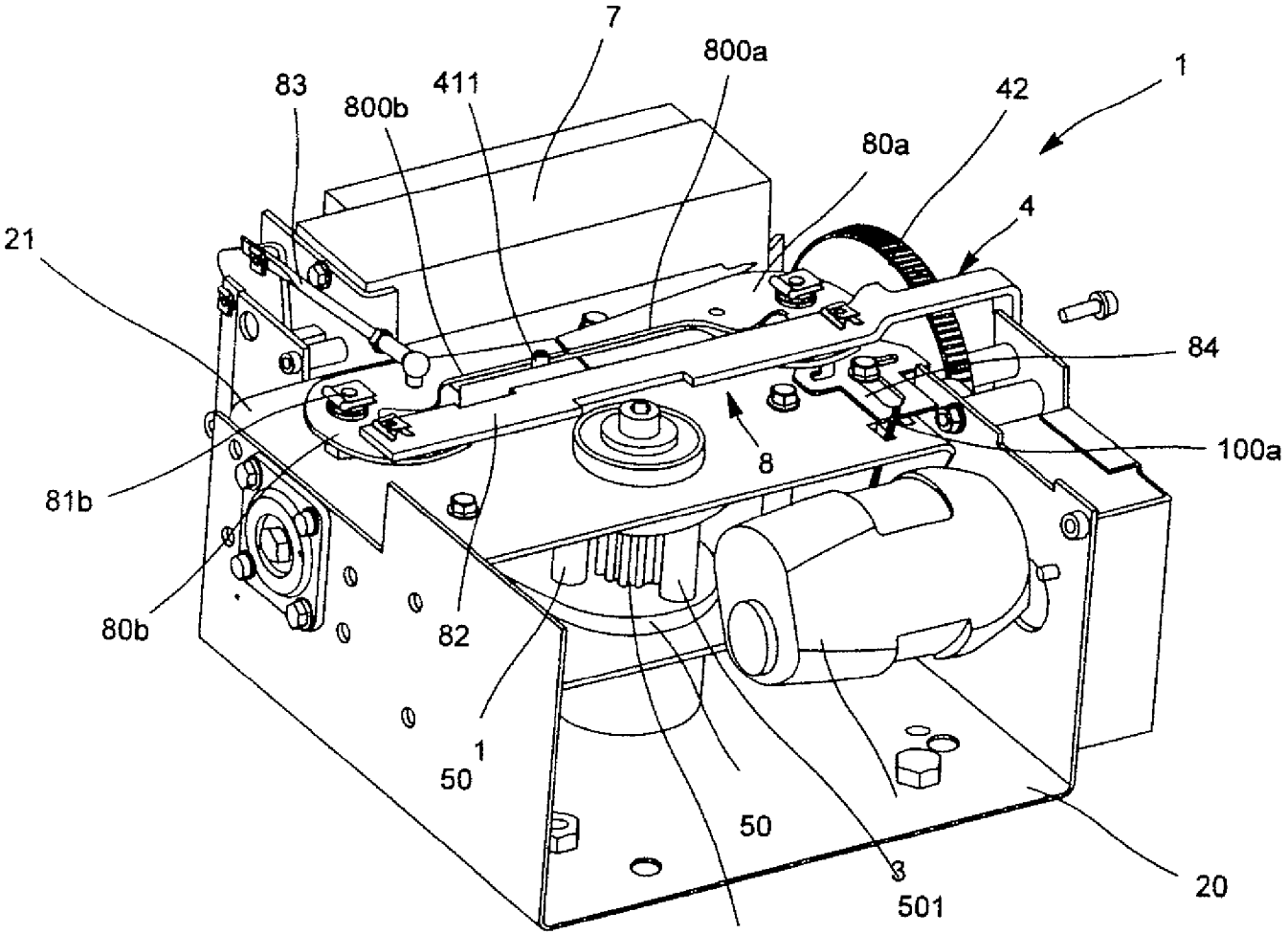
FIG. 1 is a perspective view of the actuator 1 in one embodiment of the invention.

The actuator 1 shown is an actuator for a high voltage grounding disconnector.

The actuator 1 firstly comprises a body frame 2 that includes at least one base 20 and a main support 20, which are preferably, and to advantage, fabricated from bended metal sheet. An electric motor 3 and a gear drive 4, parallel to each other, are fixed to the base 20. A drive shaft 6, extending at a right angle to the electric motor 3, is rotatably mounted in the main support 21 and base 20.

Figure 2:
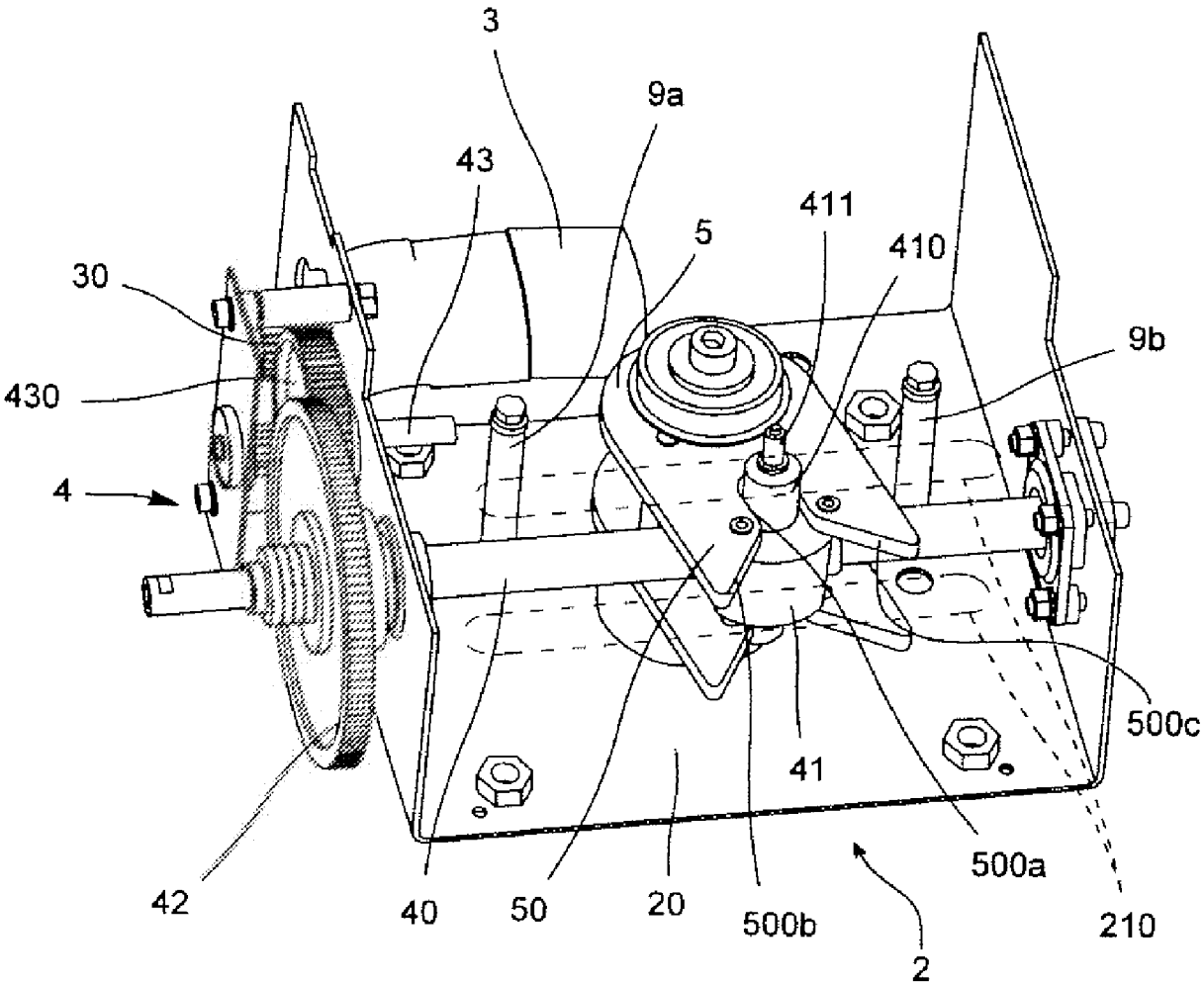
FIG. 2 is a perspective view of the actuator shown in FIG. 1, but with the auxiliary interrupter omitted, as are part of the body frame and the transmission means configured in accordance with the invention.

The gear drive 4 comprises a motor 3 with an output shaft 30, intermediate toothed wheels, and a toothed wheel 42. The toothed wheel 42 is fixed to a leadscrew or worm shaft 40 that is in threaded engagement with a rider nut 41 having a guide and drive finger 410 and a cursor spindle 411 (see FIG. 2).

A lever 5 having a fork 50 is fixed on the drive shaft 6. This shaft extends at a right angle to the worm shaft 40. The lever is so positioned that the guide finger 410 lies in the fork 50 between two predetermined positions on the worm shaft 40, so as to put the drive shaft 6 into rotation between two predetermnined positions. In other words, the lever 5, with its fork 50, is set in rotation by the guide finger 410, or, in cooperation with the cylinders 9*a* and 9*b*, is blocked in one of the two said predetermined positions. The lever 5, with its fork 50, is fixed to the drive shaft 6, with which the movable main contact of the grounding disconnector (not shown) is coupled.

In one advantageous embodiment, the toothed wheel 42 is equipped with a torque limiting device (not shown), which limits the torque transmitted from the motor 3 to the drive shaft 6. This ensures that the position of the lever 5 with its fork 50, and the position of the cursor 411 connected to the control, indication and signaling means, always corresponds to that of the main contact of the disconnector, even in the event of a jam.

In an advantageous embodiment of the invention, the support shaft 43, fixed to the toothed wheel 430, is equipped with a mechanical brake 11, which consists of a coil spring with turns 110, as is described below.

In accordance with the invention, the actuator further includes a first auxiliary interrupter 7 for breaking the power supply to the electric motor when the cursor 411 completes its movement. For this purpose, transmission means 8 are provided for transmitting the movement of the cursor 411, in the final part of its stroke, to the first auxiliary interrupter 7. The transmission means 8 comprise a pair of control levers 80*a* and 80*b* which are coupled together, with one of them, namely the lever 80*a*, coupled to the movable contact of the first auxiliary interrupter 7. Each of the levers 80*a* and 80*b* is pivotable about a pivot pin 81*a*, 81*b* respectively, which are orthogonal to the worm shaft 40, and each of the said levers also has a guide edge 800*a*, 801*a*, 802*a* and 800*b*, 801*b* and 802*b*, each of which is adapted to receive the cursor 411 in sliding engagement regardless of its position on the worm shaft 40.

Each of these guide edges consists of a straight first portion 800*a*, 800*b*, a curved portion 801*a*, 801*b*, and 800*b*, continuous with its straight portion 800*a*, and such that, when the cursor 411 is between its two positions, it slides in succession on the portions 800*b*, 800*a* that face each other and are aligned in the axis of the worm shaft, and then on one of the curved portions 801*a*, 801*b* of one of the guide edges.

The sliding movement of the cursor 411 on the curved portion 801*a* or 801*b* causes the corresponding control lever 80*a* or 80*b* to pivot (i.e. to swing pivotally), and at the same time, by means of a first coupling bar 82, it causes pivoting movement of the other lever 80*b* or 80*a*, and, by means of a second coupling bar 83, it also causes displacement of the movable contact of the auxiliary interrupter 7.

In another version that offers some advantage, two cylinders 9*a* and 9*b* extend parallel to the drive shaft 6, and are positioned at a distance such that each of them acts as an end stop for the lever 5, with its fork 50, in a respective one of the two predetermined positions of the drive shaft 6.

The two control levers 80*a* and 80*b* are preferably identical with each other.

In the embodiment shown, the actuator 1 includes a second auxiliary interrupter 10, a movable contact of which is coupled to the movable contact of the first auxiliary interrupter 7 through a third coupling bar 100, in such a way that the displacement of the auxiliary interrupter 7 causes simultaneous displacement of the other auxiliary interrupter.

The position of the cursor 411 is detected by the two control levers 80*a* and 80*b* arranged in parallel above the worm shaft 40. Each lever 80*a*, 80*b* is adapted to pivot about its pivot pin 81*a*, 81*b*, these pins being orthogonal to the worm shaft 40 and arranged on either side of the actuator 1. The first coupling bar 82, which couples the two levers 80*a* and 80*b* together, allows them to pivot in the same direction simultaneously.

The cursor 411, engaged on the guide edges 800*a*, 801*a*, 802*a*, 800*b*, 801*b* and 802*b* (in forced guiding) thus causes pivoting movement of the levers 80*a* and 80*b* as a function of its position on the worm shaft 40.

As shown, the lever 5, with its fork 50, is advantageously made from two identical metal plates 500, which are arranged parallel to each other and fixed to each other by means of several spacer bars 501, these plates being rigidly secured on the drive shaft 6. The distance between the two metal plates 500 is slightly greater than the height of the rider nut 41. Each plate 500 has a straight slot 500*a* which is continuous with inclined edges 500*b* and 500*c*. The width of the slot 500*a* is slightly greater than the diameter of the guide finger 410.

The rotational movement of the worm shaft 40 is converted into straight line (translational) movement of the rider nut 41 and guide fingers 410, the guide fingers being guided by the grooves 210 (parallel to the worm shaft 40), which are formed in the base 20 and support 21. The slot 500*a* converts the straight line movement of the nut 41, by means of the finger 410, into rotation of the drive shaft 6. The inclined edges 500*b* and 500*c* interrupt the transmission of the movement if one of the predetermined positions has been reached, and, in cooperation with the cylinders 9*a* and 9*b*, they hold the drive shaft 6 in that position.

Depending on the stage of operation of the actuator 1, the lever 5 is set in rotation by the guide fingers 410, or held against movement, by one of the end stops 9*a* or 9*b* at one of its ends, and by the guide fingers 410 interacting with the inclined edges 500*b* and 500*c* at its other end. The angle of rotation of the lever 5, with its fork 50, depends on the length and radial position of the straight slots 500*a* relative to the worm shaft 40. In the version shown, this angle is 90°.

The stages in the operation of the actuator 1 and its associated disconnector may be identified as follows:

Stage 1: End of the open position "O" (shown in FIG. 3A);

Stage 2: Start-up stage, i.e. the start of the movement with the motor 3 in rotation and the drive shaft 6 in opening position "O" (as shown in FIG. 3B);

Stage 3: Displacement stage, with the drive shaft 6 rotating and associated displacement of the high voltage movable main contact or contacts (as shown in FIG. 3C);

Stage 4: Run-off stage, i.e. the final part of the movement, in which the motor 3 is in rotation but the drive shaft 6 is at rest in the closed position "I" (as shown in FIG. 3D); and Stage 5: End of closed position "I" (shown in FIG. 3E).

The above stages of operation can take place in both directions, i.e. from "O" to "I", and from "I" to "O".

Stage 1: The lever 5 with its fork 50 is blocked by the end stop 9*b* and by the guide fingers 410. The control levers 80*a* and 80*b* and the auxiliary interrupter 7 are in the "O" position. The electric motor 3 is not energized. The lever 5 is blocked by the end stop 9*b* and by the guide fingers 410 in contact with the inclined edges 500*c*.

Stage 2: A voltage is applied to the electric motor 3, which therefore displaces the rider nut 41 on the worn shaft 40 towards the "I" position. The lever 5 is still blocked by the end stop 9*b* and guide finger 410, but the guide finger is now displaced along the inclined edges 500*c*. The drive shaft 6 is held stationary, and the high voltage contact that is fixed relative to the shaft 6 remains open. The nut 41 causes the control lever 80*b* to pivot towards an intermediate position. The control lever 80*a* therefore pivots at the same time in the same direction, due to the direct coupling provided by the first coupling bar 82. In the course of this Stage 2, the cursor 411 is displaced into the straight portion 802*b* and then into the curved portion 801*b*, and the control levers 80*a* and 80*b* turn in the clockwise direction. The auxiliary interrupter 7 is put into its intermediate position. The mechanical brake 11 is then released as is described below.

Stage 3: The cursor 411 has reached the straight portion 800*b*, and the guide fingers 410 have at the same time reached the straight slots 500*a* of the lever 5. The guide fingers 410 slide in the straight slot 500*a* of the forked lever 5. This lever is therefore rotated, and this also rotates the drive shaft 6. The high voltage movable main contact HV is then displaced towards the closed position. The control levers 80*a* and 80*b* remain in the intermediate position, that is to say with the guide edges 800*a* and 800*b* facing each other and aligned above the worm shaft 40, while the cursor 411 passes from the guide edge 800*b* of one of the levers, 80*b*, to the guide edge 800*a* of the other lever 80*a*. The auxiliary interrupter 7 remains in its intermediate position.

Stage 4: The lever 5, with its fork 50, is blocked by the end stop 9*b* and the guide fingers 410, which slide against the inclined edges 500*b*. The main high voltage contact HV, driven by the drive shaft 6, has reached its closed position. Over the same period of time, the cursor 411 enters the curved position 801*a* of the guide edge 800*a*, and the lever 80*a* is displaced towards the "I" position. The lever 80*b* turns in the same direction by virtue of the coupling made by the first coupling bar 82. The movable contacts of the first one of the auxiliary interrupters 7 are therefore displaced by the second coupling bar 83, and reach the "I" position. The power supply to the motor is thereby cut, and the mechanical brake 11 is actuated in a manner that is explained in detail below, so as to brake and check the rotation of the shaft 43 and therefore that of the gear drive 4 and motor 30. The cursor 411 is halted on the guide edge 802*a*.

Stage 5: The motor 3 and the gear drive 4 are completely stopped. The final position has been reached. The lever 5, with its fork 50, is blocked by the end stop 9*a* and by the guide fingers 410, which are engaged with the inclined edges 500*b*. In this Stage 5, the cursor 411 is engaged in the straight portion 802*a* of the guide edge close to the pivot pin 81*a*. During the engagement of the cursor 411 in the curved position 802*a*, the mechanical brake 11 is operated, and the auxiliary interrupter 7 is in the "I" position.

Guiding of the cursor 411 by at least one of the two control levers 80*a* and 80*b* is maintained during all of the Stages 1, 2, 3, 4 and 5 of the operation. In addition, due to the coupling between the two levers 80*a* and 80*b* by the coupling bar 82, the position of the two levers 80*a* and 80*b* is always controlled by the position of the rider nut 41, which therefore controls the position of the high voltage movable contacts.

Figure 4:
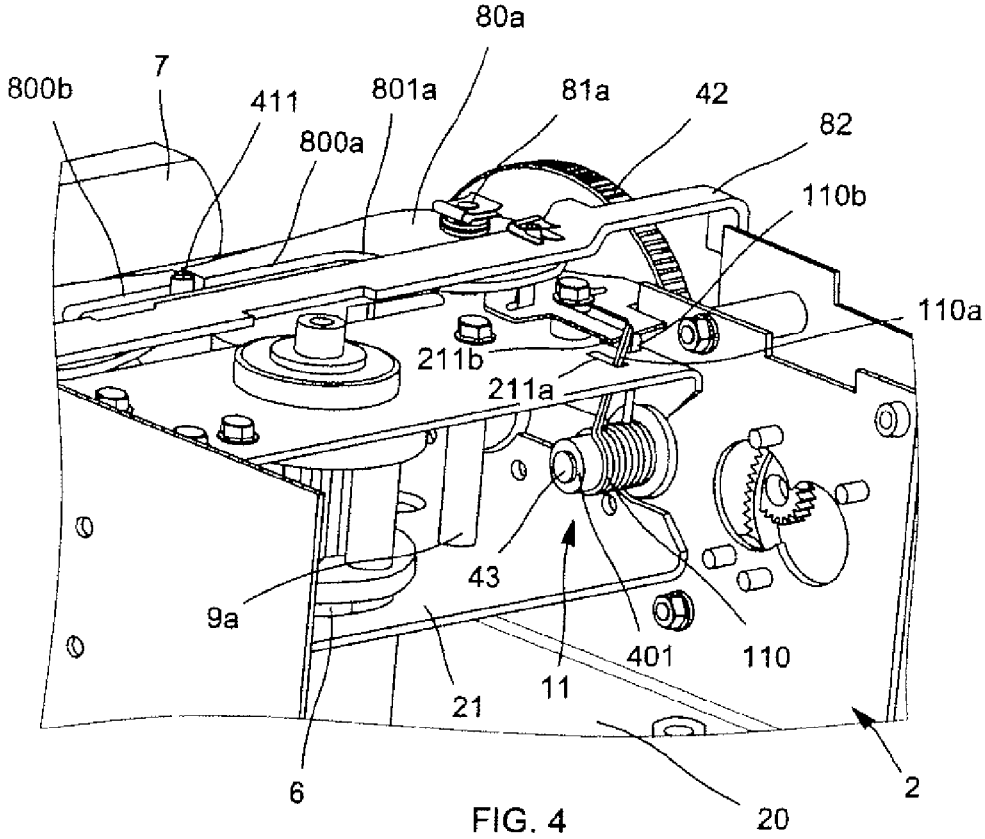
FIG. 4 is a partial view of an actuator 1, as in FIG. 1, and shows a mechanical brake in accordance with the invention in position.

As mentioned above, the actuator shown in the drawings includes a mechanical brake 11 which comprises a coil spring 110. The spring 110 acts on the shaft 43 around which it is fitted. The shaft 43 is one component of the gear drive 4, meshing through its pinion 130 directly with the toothed wheel 42. The braking torque generated by the brake 11 is smaller than the motor torque produced by the electric motor 3. The brake 11 is in a braking condition so long as no outside force is applied on one of the ends, 110*a*, of the spring 110. The inside diameter of the turns of the spring 110 in its relaxed position is slightly smaller than the outside diameter of the shaft 43, or slightly smaller than that of an intermediate sleeve 431 which is fitted over the shaft 43 (see FIG. 4). The support shaft 43 may thus consist of either a shaft which is monobloc, i.e. made in one piece, or an assembly of a shaft 43 with a sleeve 431, or a plurality of components, fitted over it.

In the embodiment shown, each of the ends 110*a* and 110*b* is guided in a slot 211*a*, 211*b* formed in the main support 21.

The main support 21 reacts to the braking force in such a way that the turns of the spring open up and cease to grip. The braking force is therefore limited to a value corresponding to equilibrium between the spring force and the friction force between the spring and the intermediate sleeve 431 which is fixed to the shaft 43. Fitting of the spring around the intermediate sleeve 431, and engagement of its ends 110*a* and 110*b* in the slots 211*a* and 211*b* of the support 21, make it possible to have a brake which does not engage by itself in the two directions of rotation of the shaft 43.

In order to operate the brake 11, a slider 84 is provided, this slider being driven in straight line movement by the control lever 80*a*. Thus, in Stage 4 when the cursor 411 is reaching the end of its movement in the curved portion 801*a* of the guide edge, the rotating lever 80*a* displaces the slider 84 in the direction (b). One of the free ends 110*a* and 110*b* of the spring 110 bears on one of the slots 211*a* or 211*b*. As to which of the free ends this is, that depends on the direction in which the motor is rotating. In consequence, the spring 110 is open at one of its ends and the braking force is limited to an equilibrium value corresponding to the tensile force in the spring and the friction force between the spring 110, in its relaxed condition, and the intermediate sleeve 431.

Figure 5:
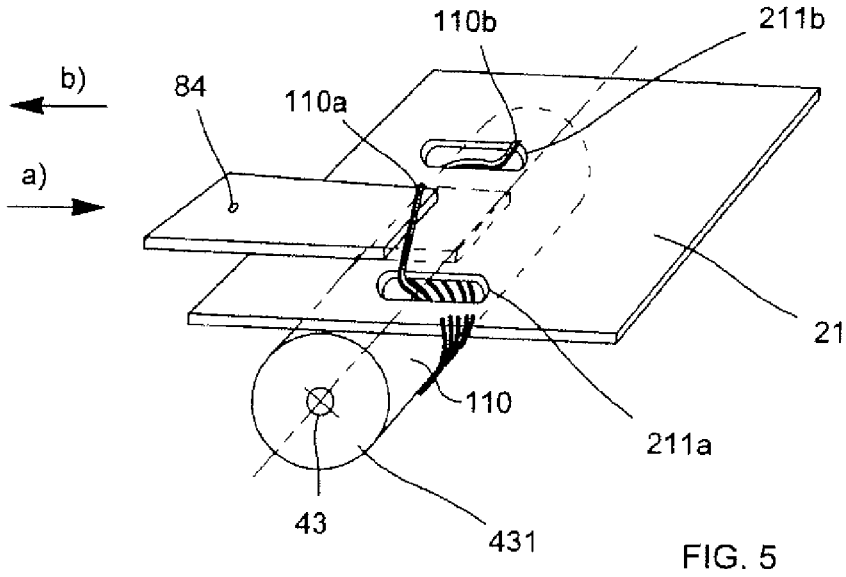
FIG. 5 is a diagrammatic view of a mechanical brake in accordance with the invention.

In order to release the brake 11 in Stage 2, when the cursor is being displaced in the guide edge 801*a* towards the edge 800*a*, the slider 84 is displaced in the direction (a), which is opposite to direction (b), and engages on the free end 110*a* of the spring 110, to displace it in the slot 211*a* formed in the support in which the end 110*a* is lodged. The other free end 110*b* is held stationary in another slot 211*b*, which is also formed in the support 21 and which is parallel with the slot 211*a*. The diameter of the turns of the spring 110 expands accordingly, and the mechanical brake 11 is released. The displacement of the slider 84 in straight line movement is controlled by the rotation of the control lever 80*a* (see FIG. 5).

The coupling between the two levers 80*a* and 80*b* by the coupling bar 82, and the coupling between the slider 84 and lever 80*a* are such that:

the slider 84 is displaced in direction (a), opposed to direction (b), and the brake is activated if the cursor 411 is approaching one of the two final positions and is in one of the curved portions 801*a* or 801*b*, that is to say beyond the two predetermined positions of the drive shaft 6; and the slider 84 is displaced in direction (a), opposite to direction (b), and the brake is released if the cursor is on one of the straight guide edges 800*a* or 800*b*, that is to say between the two predetermined positions of the drive shaft 6.

The actuator 1 in the embodiment shown includes a second auxiliary interrupter 10. The movable contact of the second auxiliary interrupter 10 is coupled to the movable contact of the first auxiliary interrupter 7 through a third coupling bar 100. Thus, displacement of the movable contact of the interrupter 7 causes simultaneous displacement of the movable contact of the auxiliary interrupter 10.

Figure 3A:
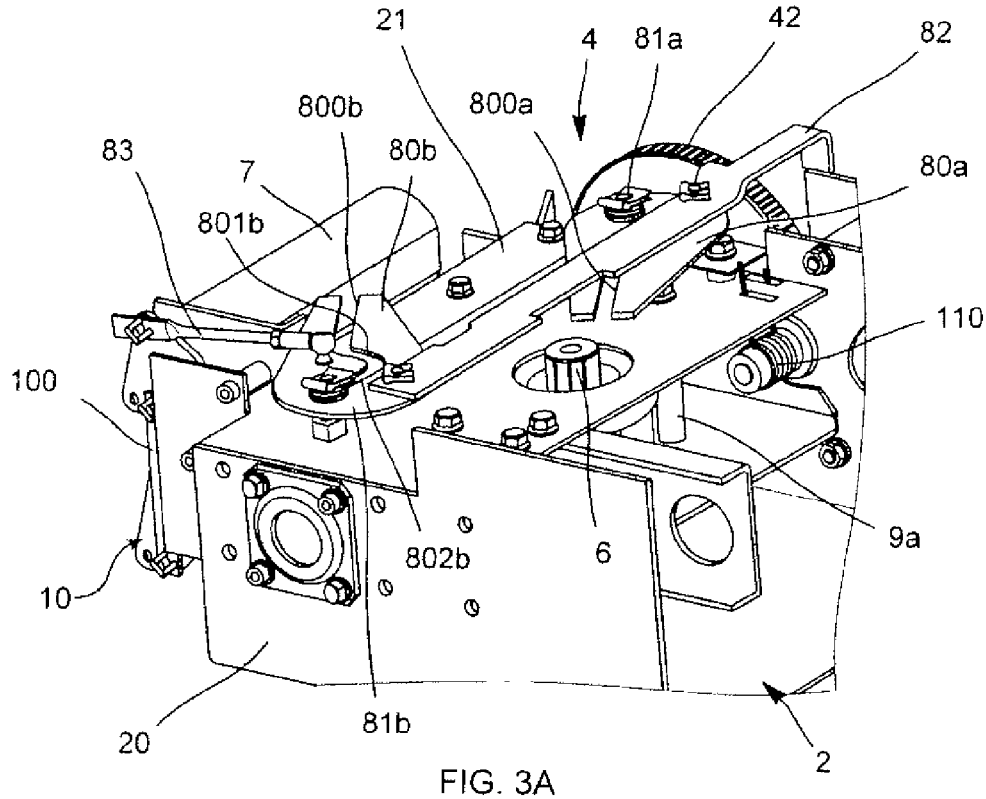
FIGS. 3A to 3E are partial views showing the various consecutive steps in the operation of the actuator shown in FIG. 1.
Figure 3B:
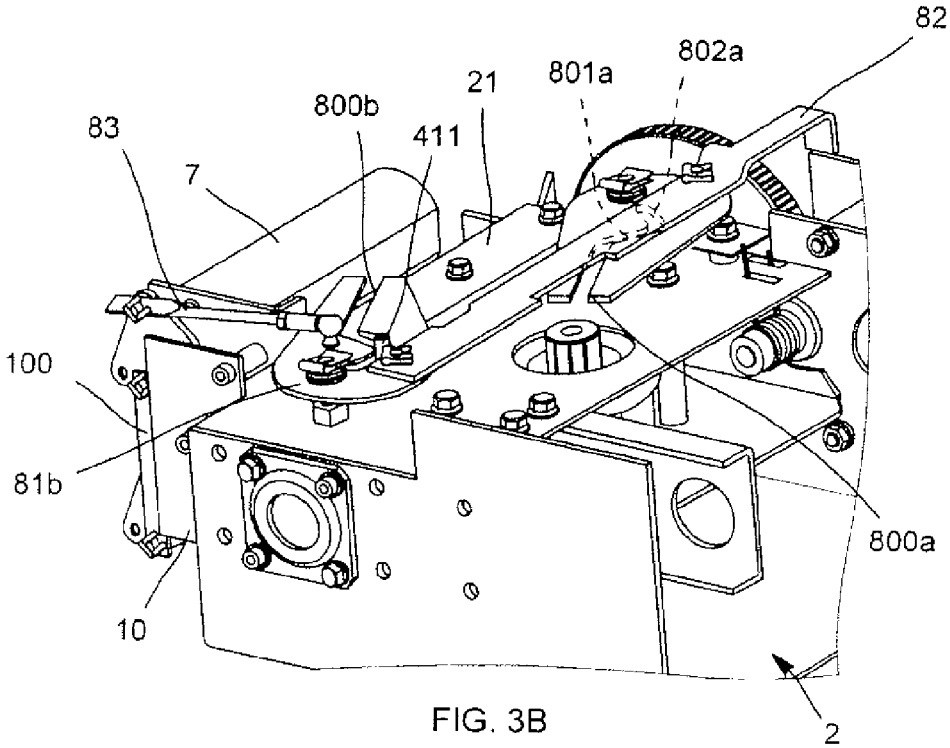
Figure 3C:
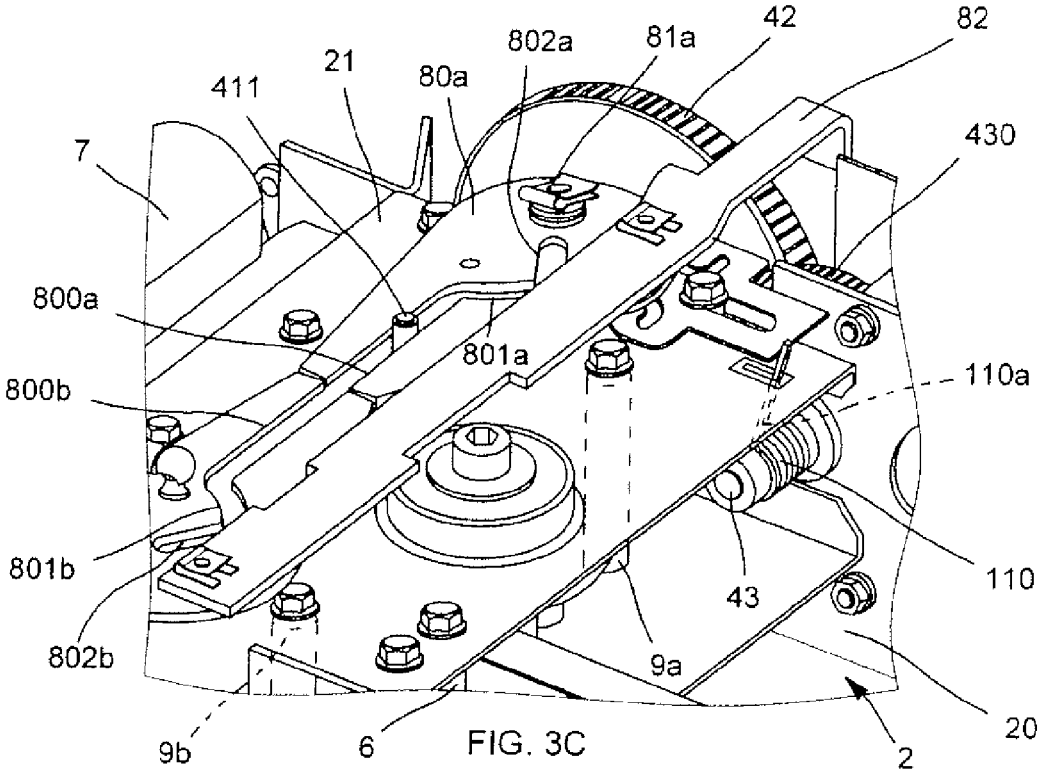
Figure 3D:
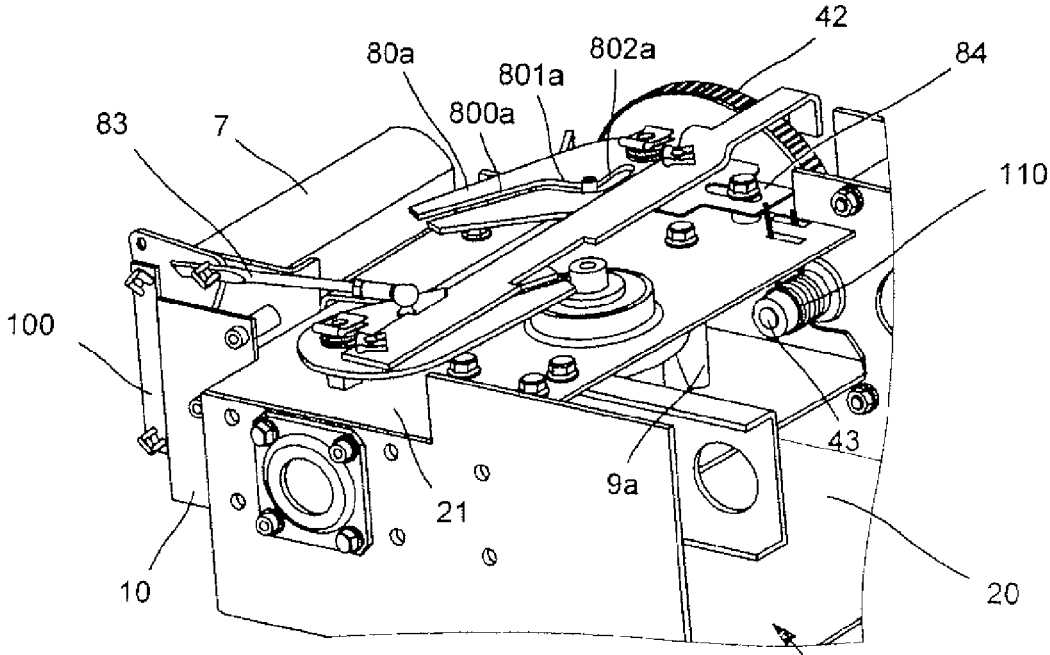
Figure 3E:
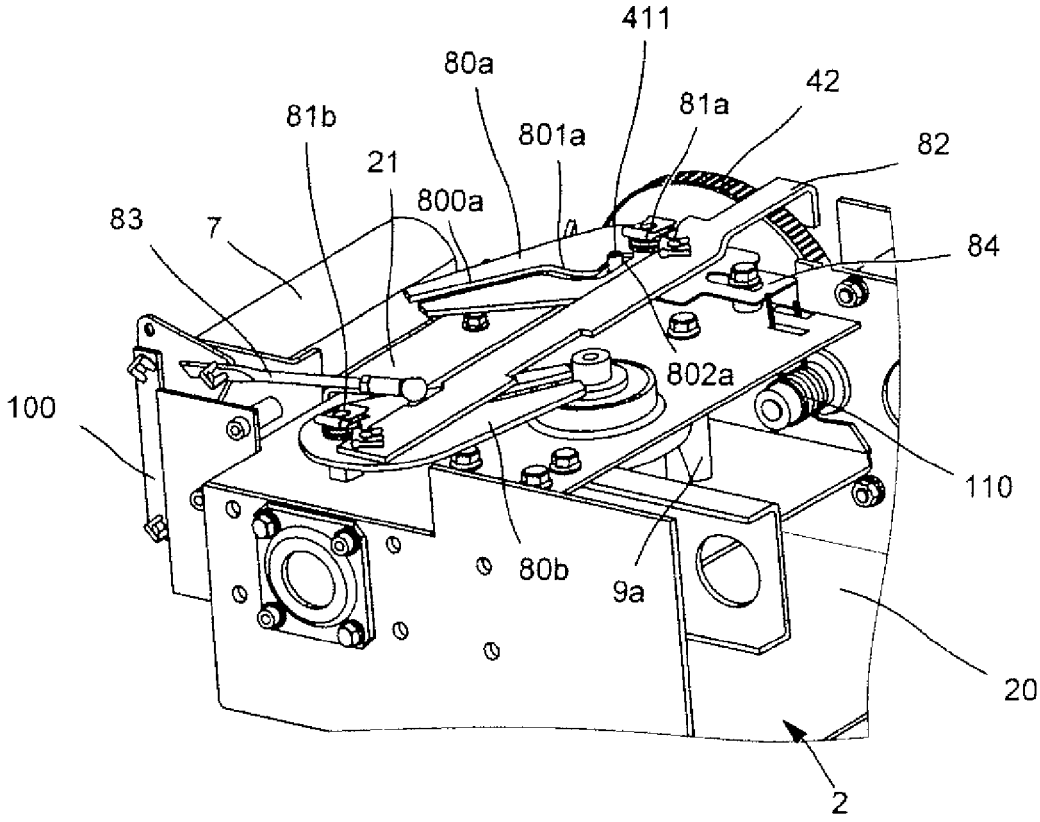

More precisely, where the apparatus having the actuator 1 of the invention is a high or medium voltage disconnector, the auxiliary interrupter 10 indicates that the disconnector is in the "O" switching state until the cursor 411 reaches the curved portion 801*b* of the pivoting lever 80*b* (see FIGS. 3A and 3B). Just before the cursor 411 reaches the straight portion 800*b*, the movable contact of the auxiliary interrupter is deflected into the "intermediate" switching state, and stays in that position while the cursor 411 is moved into the straight portions 800*b* and 800*a* (see FIG. 3C). When the cursor 411 reaches the curved zone 801*a*, the movable contact of the auxiliary interrupter 10 is deflected simultaneously with the movable contact of the auxiliary interrupter 7, and indicates accordingly the "I" switching state of the disconnector (see FIG. 3D).

The second straight portion 802*a*, 802*b* of the guide edges is continuous with the curved portion 801*a* or 801*b*. The length of this second straight portion 802*a* or 802*b* enables the cursor 411 sliding within it to stop without the levers 80*a* and 80*b* pivoting, once the power to the electric motor has been switched off by the auxiliary interrupter 7 in its switching position (see FIG. 3E).

The actuator which has just been described is particularly suitable for the control of high or medium voltage disconnectors: the rotating drive shaft 6 may operate high voltage or medium voltage movable main contacts.

The invention claimed is:

1. An actuator of an electromagnetic type comprising:

an electric motor;

a gear drive, including a worm shaft adapted to be rotated by the motor, and a rider nut that is in threaded engagement with, and around, the worm shaft and that has a guide finger and a cursor spindle;

a lever having a fork and fixed to a drive shaft that extends at a right angle to the worm shaft, the lever being so positioned as to locate the guide finger in the fork between two predetermined positions on the worm shaft, whereby to rotate the drive shaft between two predetermined positions (I and O);

a first auxiliary interrupter for breaking the power supply to the electric motor at the end of the stroke of the cursor; and transmission means for transmitting the movement of the cursor at the end of the stroke of the first auxiliary interrupter, whereby to put it in a switching position, the said transmission means comprising a pair of coupled-together control levers, one said control lever being coupled to a movable contact of the first auxiliary interrupter, each of the control levers being pivoted about a pivot pin which is orthogonal to the worm shaft, and each said control lever having a guide edge, the arrangement of the levers and the profiles of their guide edges being such as to enable the cursor to slide on the guide edges regardless of the position on the worm shaft, by causing the control levers to stop or pivot simultaneously, whereby the simultaneous pivoting movement of the levers puts the auxiliary interrupter into a switching position.

2. An actuator according to claim 1, wherein each lever guide edge has a straight first portion and a curved portion continuous with its straight portion, the respective lengths of the straight first portion and the curved portion being such as to permit the cursor to slide in the said portions as follows:

in the straight portions, aligned with each other, without causing the control levers to pivot when the drive shaft is between the two said predetermined positions (I and O); and in the curved portions by causing the control levers to pivot simultaneously when the drive shaft is in a position immediately after one of the said predetermined positions (I and O).

3. An actuator according to claim 2, wherein each guide edge includes a second straight portion continuous with the curved portion, the length of the second straight portion being such as to permit the cursor sliding in it to stop without any pivoting movement of the levers, after the power supply to the electric motor has been broken by the auxiliary interrupter in its switching position.

4. An actuator according to claim 1, wherein the two control levers are coupled together by means of a first coupling bar.

5. An actuator according to claim 1, wherein the control levers are coupled together in such a way as to pivot in the same direction of rotation.

6. An actuator according to claim 1, wherein one of the control levers is coupled to the first auxiliary contact by means of a second coupling bar.

7. An actuator according to claim 1, wherein two cylinders extend parallel to the drive shaft and are positioned at a distance such that each of them acts as an end stop for the lever having the fork in one of the two predetermined positions of the drive shaft.

8. An actuator according to claim 1, wherein the two control levers are identical to each other.

9. An actuator according to claim 1, wherein one of the control levers is coupled to a slider member, the coupling between the said lever and the slider being so arranged that, when the lever is in its pivoted position corresponding to a position of the cursor beyond the two said predetermined positions (I and O), the slider, in straight line movement, actuates a mechanical brake for the gear drive, and, when the lever is in an unpivoted position corresponding to an intermediate position of the cursor between the two said predetermined positions (I and O), the slider, in straight line movement in the opposite direction, releases the mechanical brake.

10. An actuator according to claim 1, including a body frame having at least one base on which the motor and gear drive are fitted, and further having a main support on which the drive shaft is rotatably mounted, the main support and the base being fabricated from sheet metal.

11. A high or medium voltage interrupter such as a grounding disconnector, including an actuator of an electromechanical type according to claim 1, wherein the drive shaft is coupled to the main movable contact of the interrupter, the said predetermined positions of the drive shaft being the open position (O) and the closed position (i) of the main contact.

* * * * *